US009802747B2

(12) United States Patent
Sanderson

(10) Patent No.: US 9,802,747 B2
(45) Date of Patent: Oct. 31, 2017

(54) PACKAGE SYSTEM FOR ELECTRONIC DEVICES

(71) Applicant: Ecospan USA, Greenbrae, CA (US)

(72) Inventor: Scott W. Sanderson, Chester Springs, PA (US)

( * ) Notice: Subject to any disclaimer, the term of this patent is extended or adjusted under 35 U.S.C. 154(b) by 0 days.

(21) Appl. No.: 14/523,749

(22) Filed: Oct. 24, 2014

(65) Prior Publication Data

US 2016/0114953 A1 Apr. 28, 2016

(51) Int. Cl.

| | |
|---|---|
| ***B65D 81/02*** | (2006.01) |
| ***B65D 85/30*** | (2006.01) |
| ***B65B 5/04*** | (2006.01) |
| ***B65D 43/16*** | (2006.01) |
| ***B65D 85/00*** | (2006.01) |
| ***B65D 81/127*** | (2006.01) |

(52) U.S. Cl.

CPC ..... *B65D 81/022* (2013.01); *B65B 5/04* (2013.01); *B65D 43/16* (2013.01); *B65D 81/127* (2013.01); *B65D 85/30* (2013.01); *B65D 85/70* (2013.01); *B65D 2585/6837* (2013.01)

(58) Field of Classification Search

CPC .... B65D 81/07; B65D 81/075; B65D 81/022; B65D 85/30

USPC ..... 206/583, 586, 320, 454

See application file for complete search history.

(56) References Cited

U.S. PATENT DOCUMENTS

| | | | | | |
|---|---|---|---|---|---|
| 4,093,068 | A * | 6/1978 | Smrt | B65D 81/127 | 206/433 |
| 5,217,131 | A * | 6/1993 | Andrews | B65D 81/052 | 206/522 |
| 5,363,956 | A * | 11/1994 | Taniyama | G11B 33/0416 | 206/309 |
| 5,529,187 | A * | 6/1996 | DeNola | B65D 85/38 | 206/449 |
| 5,553,444 | A * | 9/1996 | Lovecky | B65D 81/07 | 206/561 |
| 5,924,574 | A * | 7/1999 | Ku | B65D 81/051 | 206/320 |
| 6,629,616 | B1 * | 10/2003 | Heinzle | A63C 11/028 | 211/85.7 |
| 7,299,925 | B1 * | 11/2007 | Ansay | B65D 85/68 | 206/522 |
| 8,353,400 | B2 * | 1/2013 | Santy | 190/102 | |
| 2003/0057131 | A1 | 3/2003 | Diaferia | | |

(Continued)

FOREIGN PATENT DOCUMENTS

| | | | |
|---|---|---|---|
| DE | 20 2013 101700 | U1 | 5/2013 |
| GB | 2461568 | A | 1/2010 |

*Primary Examiner* — Steven A. Reynolds

(74) *Attorney, Agent, or Firm* — Baker & Hostetler LLP

(57) ABSTRACT

A package system configured transport an item, for example, an electronic device. The package system includes a case having a case body and a lid moveably connected to the case body. The package system can include a suspension unit sized to fit in the interior space of the case. The suspension unit includes a base and a side wall that extends from the base in a direction angularly offset with respect to the base. The suspension unit includes a plurality of suspension elements disposed along the base and the side wall. The plurality of suspension elements are configured to bend so as to absorb impact forces applied to case in at least a first direction and a second direction that is angularly offset with respect to the first direction.

15 Claims, 17 Drawing Sheets

(56) References Cited

U.S. PATENT DOCUMENTS

| | | | | |
|---|---|---|---|---|
| 2003/0209463 | A1* | 11/2003 | Halpin | B65D 81/07 206/583 |
| 2003/0217940 | A1* | 11/2003 | Russell | A45C 3/02 206/320 |
| 2004/0094448 | A1 | 5/2004 | Koike | |
| 2005/0284791 | A1* | 12/2005 | Sadow | B65D 81/052 206/522 |
| 2009/0326707 | A1 | 12/2009 | Matilla | |
| 2011/0031159 | A1 | 2/2011 | Minamino et al. | |

* cited by examiner

PACKAGE SYSTEM FOR ELECTRONIC DEVICES

TECHNICAL FIELD

The present disclosure relates to a package system used to transport electronic devices, such as smartphones, tablets and the like.

BACKGROUND

Electronic devices sometimes are repaired, replaced, or refurbished after purchase. Returning electronic devices that have been damaged involves a user shipping the electronic devices to the manufacturer or a third party. The device is then replaced, repaired or refurbished. In some cases a replacement is sent to the user while the user's damaged device is on the way to the manufacturer. Ensuring that the replacement device arrives to the user in proper working order without damage or defect is critical. Typically, replacement devices are shipped in padded mailers or packages that include paper-based cartons, polystyrene blocks or foam that protect the replacement devices during transit. Such replacement packages are often disposed by the user in the trash. Electronic device manufacturers are now more than ever managing the complete life cycle of the devices they market, including, how the replacement and/or damaged devices and packaging are disposed.

SUMMARY

An embodiment of the present disclosure is a package system configured transport an item, for example an electronic device. The package system includes a case having a case body and a lid moveably connected to the case body. The lid is moveable between a closed position where the lid encloses an interior space of the case and on open position where the lid does not enclose the interior space. The package system can include a suspension unit sized to fit in the interior space of the case. The suspension unit includes a base and a side wall that extends from the base in a direction angularly offset with respect to the base. The base and the side wall define a receptacle that is sized to receive the item. The suspension unit includes a plurality of suspension elements disposed along the base and the side wall. The plurality of suspension elements are configured to bend so as to absorb impact forces applied to case in at least a first direction and a second direction that is angularly offset with respect to the first direction.

Another embodiment of the present disclosure is a suspension unit configured to hold an electronic device in a case. The suspension unit includes a base including a plurality of base suspension elements. Each base suspension element defines an elongate body that extends in a longitudinal direction. The elongate body includes a plurality of alternating peaks and valleys disposed relative to each other in the longitudinal direction. The plurality of base suspension elements are configured to bend in response to a first force along a first direction that is perpendicular to the longitudinal direction. The suspension unit also includes a side wall that projects from the base in a direction angularly offset with respect to the base. The side wall defines an inner surface and an opposed outer surface. The inner surface defines a receptacle sized to receive the electronic device. The side wall includes a plurality of side suspension elements. Each side suspension element includes a contact member spaced apart from the side wall and configured move toward the side wall response a second force directed against the side wall in a second direction that is perpendicular to the first direction.

Another embodiment of the present disclosure is a method of manufacturing a package system configured to transport an electronic device. The method includes forming a case that is sized to contain an electronic device, and forming a suspension unit including a base and a wall that projects from the base. The base and the side wall define a receptacle that is sized to receive the electronic device. The suspension unit includes a plurality of suspension elements disposed along the base and the side wall. The suspension unit and the case are formed from a polymeric compound. Further, the plurality of suspension elements are configured to bend so as to absorb impact forces applied to the case in at least a first direction and a second direction that is angularly offset with respect to the first direction.

Another embodiment of the present disclosure is a method for supplying electronic devices. The method includes positioning a first electronic device in a polymeric package system, the package system including a case and a suspension unit positioned in the case. The suspension unit includes a base and a side wall that extends from the base in a direction angularly offset with respect to the base. The base and the side wall define a receptacle that is sized to receive the first electronic device. The suspension unit includes a plurality of suspension elements disposed along the base and the side wall. The method includes shipping the package system and the first electronic device to a first location. Further, the method can include receiving the package system a second electronic device that is different than the first electronic device. The method includes removing the second electronic device from the receptacle package system. The method can include causing the returned package system to be recycled as a component of the additional package system formed according to method described above.

BRIEF DESCRIPTION OF THE DRAWINGS

The foregoing summary, as well as, the following detailed description of illustrative embodiments of the present application, will be better understood when read in conjunction with the appended drawings. For the purposes of illustrating the present application, there is shown in the drawings illustrative embodiments of the disclosure. It should be understood, however, that the application is not limited to the precise arrangements and instrumentalities shown. In the drawings.

DETAILED DESCRIPTION OF ILLUSTRATIVE EMBODIMENTS

Figure 1:
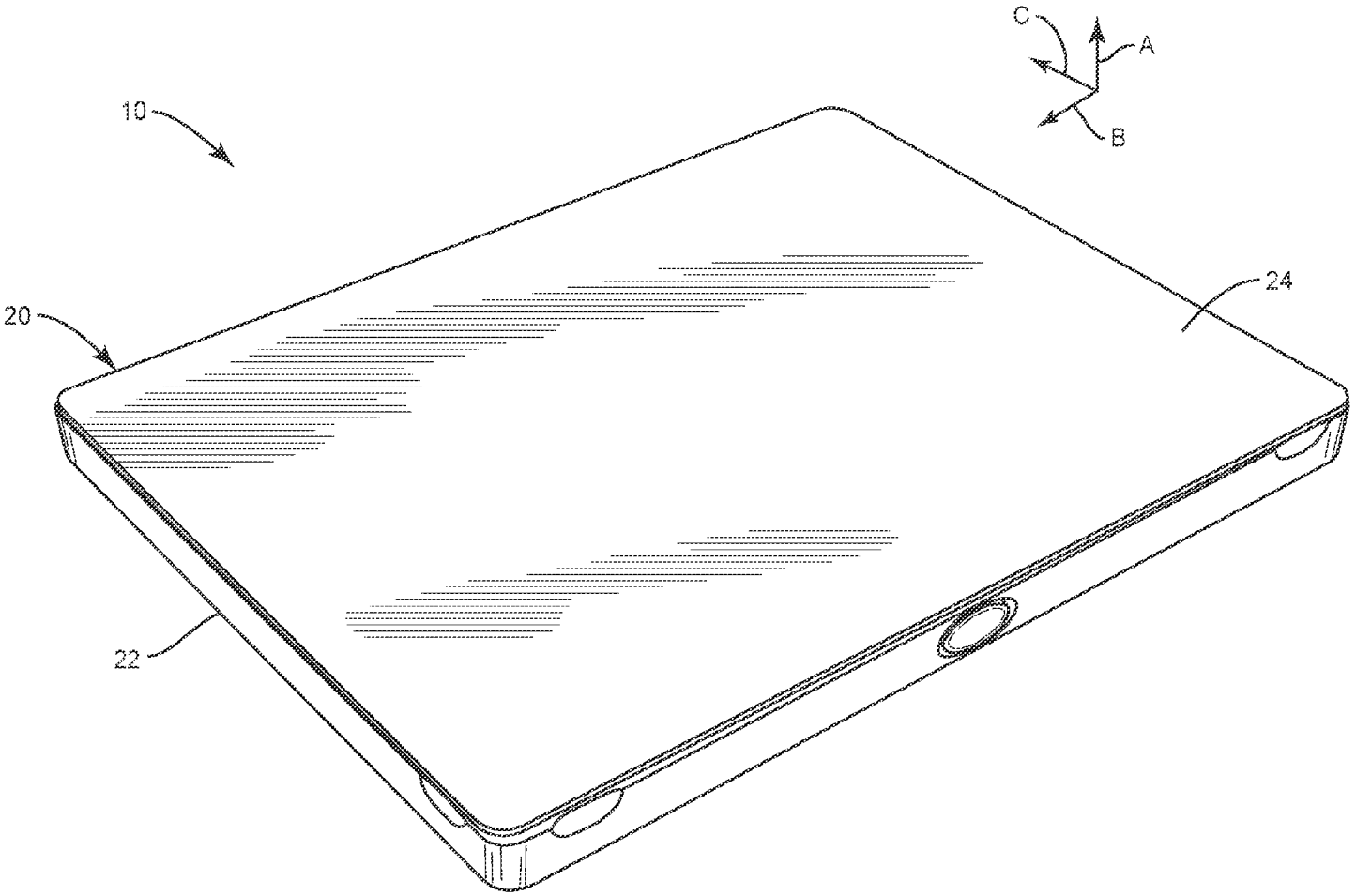
FIG. 1 is a front perspective view of a package system configured to transport an electronic device according to an embodiment of the present disclosure.
Figure 2:
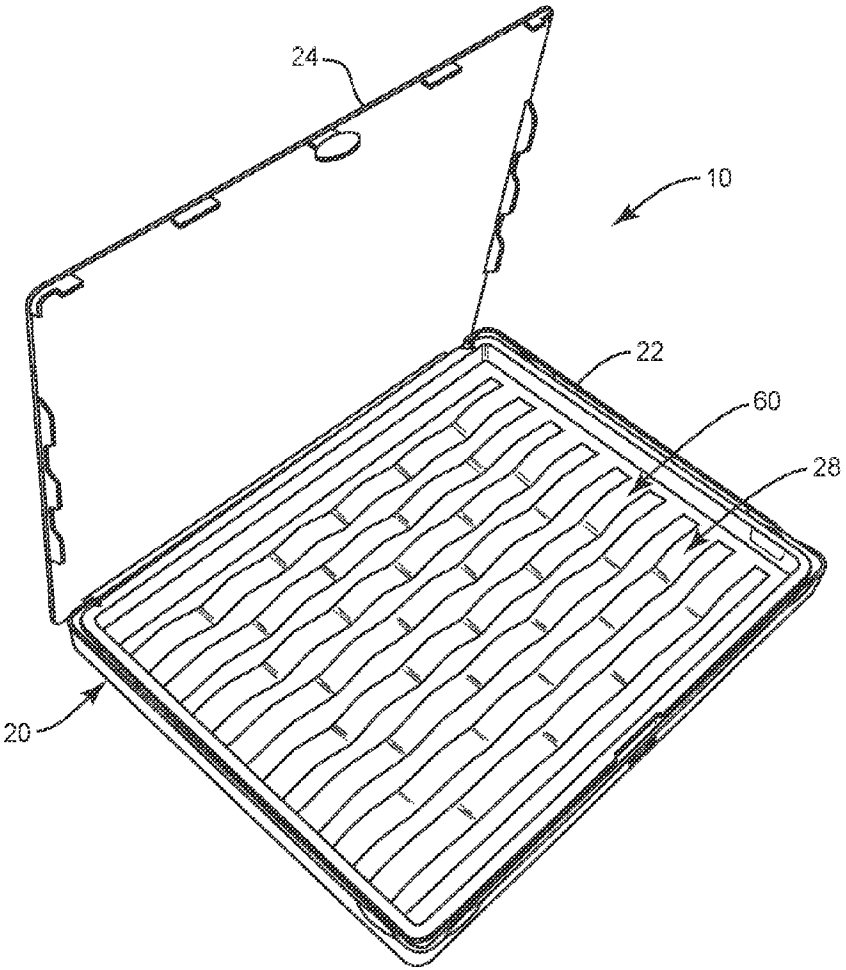
FIG. 2 is a front perspective view of the package system shown in FIG. 1, illustrating a case open and a suspension unit positioned in the case.

Referring to FIG. 1, an embodiment of the present disclosure is a package system 10 configured to support an electronic device 12 (electronic device not shown) during transport from one location to another. The package system 10 includes a case 20 and a suspension unit 60 (FIG. 2) sized to removably fit inside the case 20. The suspension unit 60 includes a plurality of suspension elements that support the electronic device 12 in at least two directions, for instance three orthogonal directions. The package system 10 is configured to inhibit sudden movement of the electronic device 12 within the case 20 while supporting the electronic device 12 in such a way that the suspension elements absorb most, if not all of the shocks exposed to the package system 10 during shipment. The package system 10 is scalable. The package system 10 can be configured to function with several different sized electronic devices, such as, e.g. smartphones and tablets. Smartphone devices may include the full range of iPhone products marketed by Apple Inc. now available or available in the future. Likewise, tablets include the full range of iPad products marketed by Apple Inc. now available or available in the future. The package system is not limited to use with iPhone or iPad products. Other devices, such as the Galaxy can be packed into the packaging system 10. Tablets could include the Nexus One, by Google Inc., or the SurfacePro products marketed by the Microsoft Inc. Other electronic devices are suitable as well.

As noted above, when the electronic device 12 is damaged and replacement or repair is warranted, a replacement electronic device may be shipped to a user. The user typically sends the damaged device to the manufacturer or 3$^{rd}$ party handler in a package provided in the shipment with the replacement electronic device. In accordance with an embodiment of the present disclosure, the package system 10 can be used as the replacement package for the replacement devices, as well as the package for the damaged device that is returned to the manufacturer. That is, the replacement device can be shipped to the user in the package system 10. The user can, in turn, send the damaged device back the manufacturer inside package system 10. The returned package system 10 can be recycled and used as a portion up to all of the material used to manufacture the package system 10. In any event, the package system 10: 1) is a reliable, durable system for transporting electronic devices and minimizing in-transit damage, and 2) can be recycled and repurposed into the supply chain for replacement devices. Additionally, in certain embodiments, the package system 10 eliminates use of polystyrene-based or paper based materials for replacement packaging.

Figure 4:
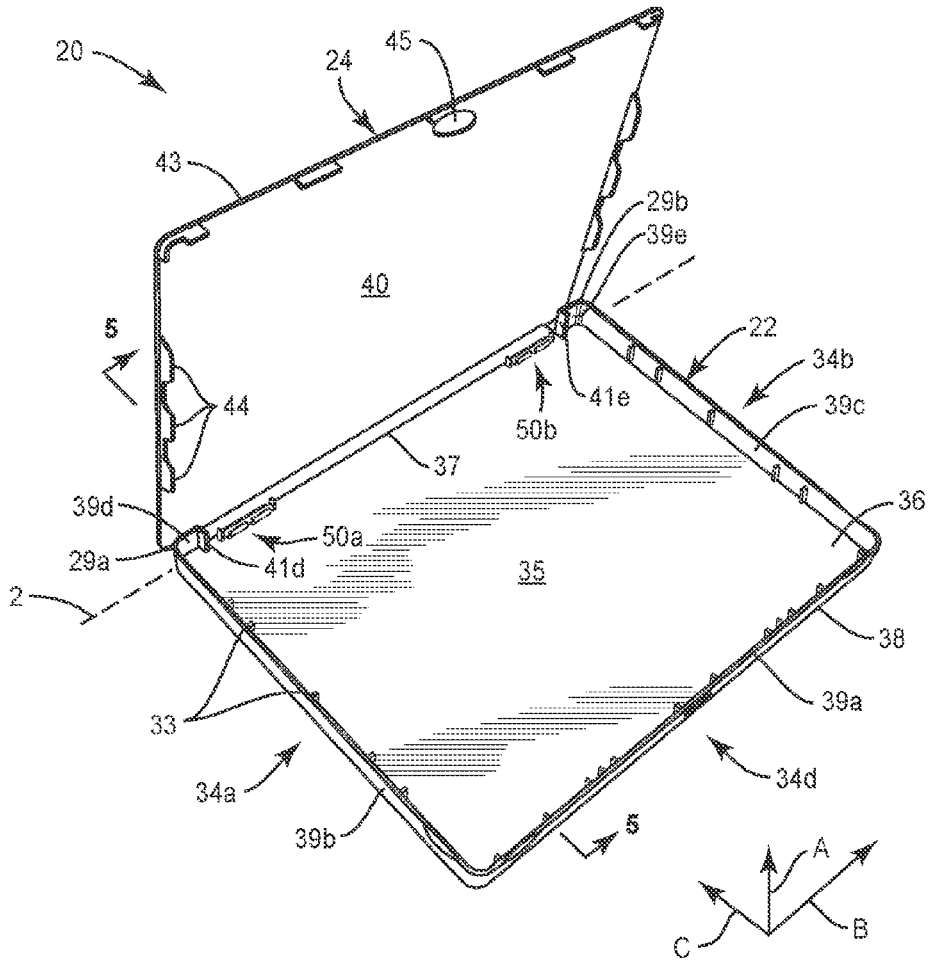
FIG. 4 is a perspective view of the case shown in FIG. 1 open and with the suspension unit and electronic device removed.
Figure 5:
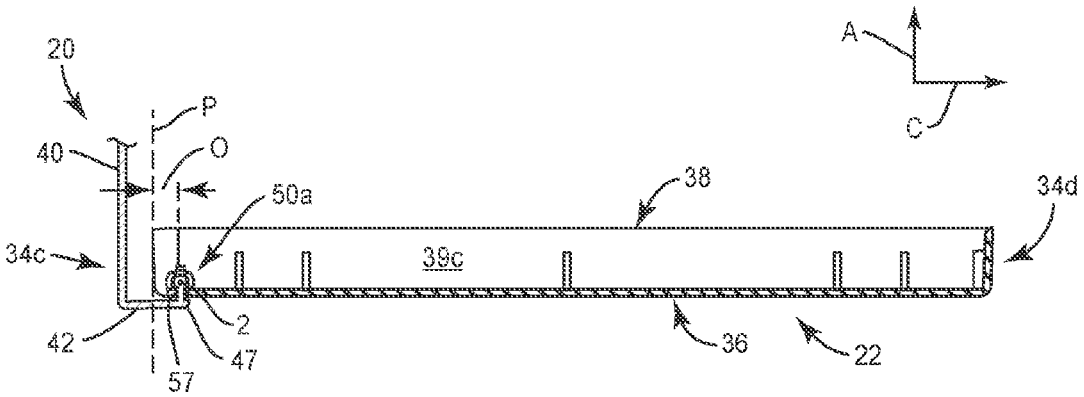
FIG. 5 is a cross-sectional view of the case open and taken along lines 5-5 in FIG. 4.

Referring to FIGS. 4-5, the case 20 is configured to hold the suspension unit 60 and electronic device 12. The suspension unit 60 and electronic device 12 are not shown in FIGS. 4-5. In accordance with the illustrated embodiment, the case 20 includes a case body 22 and a lid 24 that is moveably connected to the case body 22 via one or more connectors 50*a*, 50*b*. The lid 24 is moveable between a closed position (FIG. 1) where the lid 24 encloses an interior space 28 of the case and on open position (FIG. 4) where the lid 24 does not enclose the interior space 28. The lid 24 is shown pivotable about a pivot axis 2 defined by the connectors 50*a* and 50*b* between the open and closed positions. Operation of the lid 24 is not limited to a pivoting motion. For instance, in alternative embodiments, the lid 24 can slide along the body 22 between the opened and closed positions. In some instances, the lid 24 can be separable from the case body 22 to define the open position.

Figure 3:
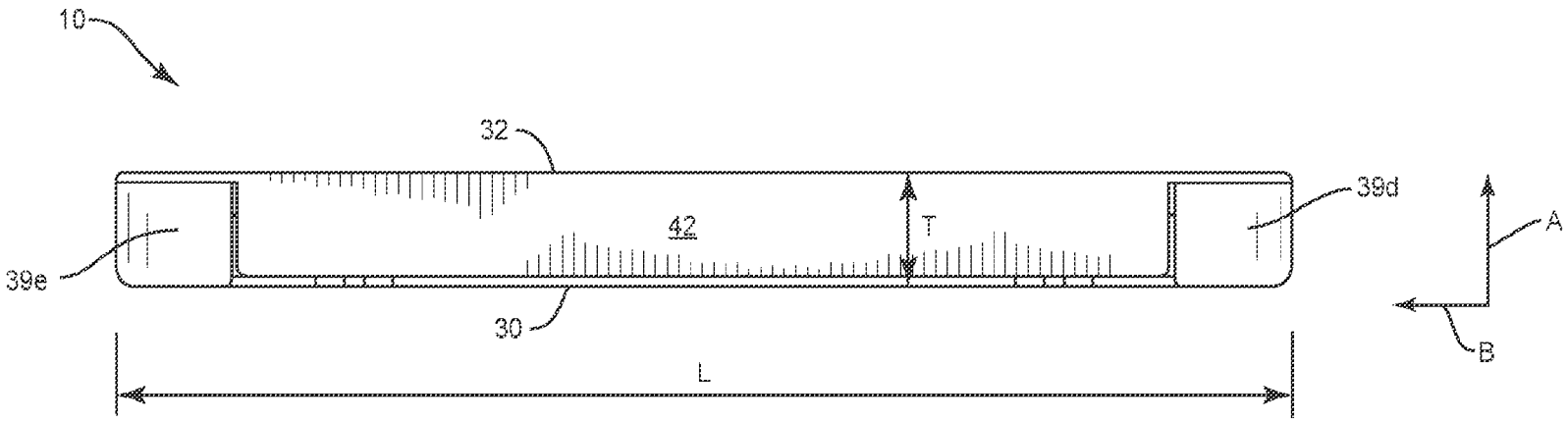
FIG. 3 is a rear view of the package system shown in FIG. 1.

Referring to FIGS. 3-5, the case 20 has dimensions selected particular electronic device it will hold. The case 20 defines a bottom surface 30 and a top surface 32 spaced from the bottom surface 30 along a vertical direction A when the lid 24 is closed. The case 20 can have a closed thickness T that extends from the bottom surface 30 to the top surface 32 in the vertical direction A. The case 20 further defines first end 34*a*, a second end 34*b* spaced from the first end 34*a* along a longitudinal direction B that is perpendicular to the vertical direction A. The case 20 has a length L that extends from the first end 34A to the second end 34*b* along the longitudinal direction B. In addition, the case 20 has rear and front sides 34*c* and 34*d* that are spaced apart with respect to each other along a lateral direction C that is perpendicular to the vertical and longitudinal and directions A and B. The case 20 defines width W that extends from the rear side 34*c* to the front side 34*d* along the lateral direction C. In accordance with the embodiment illustrated, the case 20 is sized and configured to hold the electronic device 12, such as an iPad, and has a rectilinear cross-sectional shape perpendicular to the vertical direction A, such that the length L is greater than the width W. It should be appreciated that the width W can be equal to the length L or greater than the length L, as needed. Further, the thickness T is generally less than width W and length L and is selected to correspond to the thickness profile of the electronic device 12 which the case 20 will hold.

Continuing with FIGS. 4 and 5, the case body 22 includes a base 36 and a side wall 38 that extends from the base 36 along the vertical direction A. The base 36 and side wall 38 define the interior space 28. As illustrated, the base 36 is generally planer and is monolithic with the side wall 38. However, the side wall 38 can be coupled to the base 36 during assembly. The base 36 defines the bottom surface 30 of the case 20 and include an inner surface 35 opposed to the bottom surface 30. The side wall 38 includes a front segment 39*a* and side wall segments 39*b* and 39*c* that extend around part of base 36. Front segment 39*a* and side wall segments 39*b* and 39*c* join to define front corners 29*a*. The wall further includes rear segments 39*d* and 39*e* joined to side wall segments 39*b* and 39*c* to define rear corners 29*b*. The rear segments 39*d* and 39*e* extend from the corners 29*b* toward each other in the longitudinal direction B and define a rear slot that extends along a rear edge 37 of the base 36. Tabs 41*d* and 41*e* extend rear segments 39*d* and 39*e* in the lateral direction C toward the front wall segment 39*a*. The rearward-most surface (not numbered) of the segments 39*d* and 39*e* are aligned along a plane P that is perpendicular the lateral direction C. The rear edge 37 extends from one segment 39*d* to the other segment 39*e* and is parallel to and offset from the plane P by an offset distance O. The offset distance provides clearance for the connectors 50*a* and 50*b* that couple the lid 24 to the body 22 such that when the lid 24 is closed, rear side 34C of the case 20 is generally aligned with the plane P. Each wall segment 39*a*-39*c* includes retention members 33 that help secure the lid 24 in place in the closed position as will be discussed further below.

Turning to FIGS. 3-5, the lid 24 includes a top cover 40 and a rear wall 42 that extends from the top cover 40 along a direction that is orthogonal to the cover 40. The top cover 42 is a generally planar body with an edge 43 that corresponds to the side wall 38 of the base 36 such that when the lid 24 is closed, the edge 43 of the top cover 40 aligns with side wall 38. The lid 40 includes plurality of retention tabs 44 and a latch member 45 that depend from the top cover along the edge 43. The retention tabs 44 can engage with retention members 33 in the base 36 to secure the edge 43 of the top cover 42 against the side wall 38. The latch 45 fits within an aperture 31 in the front wall segment 39*a* of the base 36 and maintain the lid 24 in the closed position. The rear wall 42 extends from the top cover 40 and terminates at a lower edge 47. When the lid 24 is closed, the lower edge 47 of the rear wall 42 is aligned with the base 36. A rod 58 extends from the lower edge 47 of the rear wall 42 and is connected to the base 36 as will be further detailed below.

Figure 6:
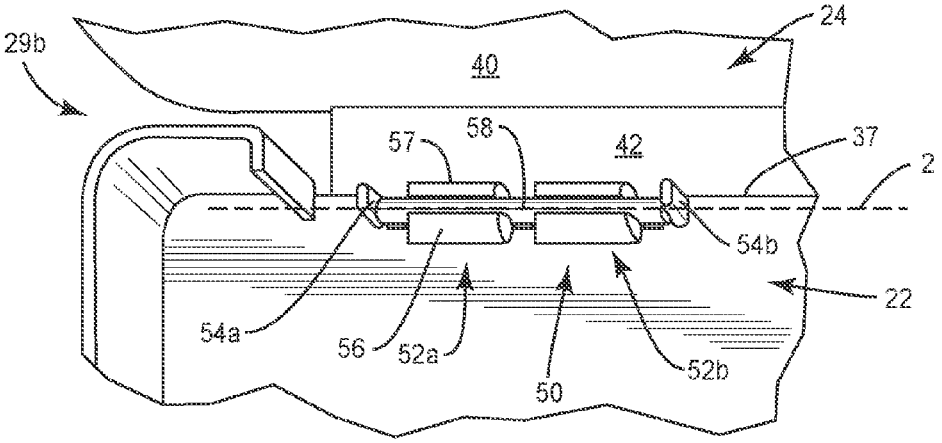
FIG. 6 is a detailed perspective view of a connector for the case shown in FIG. 5.

Turning to FIGS. 4-6, the case 20 includes a plurality of connectors that moveably connect the lid 24 to the body 22. The connector is selected based on the size and weight of the electronic device 12 to be held by the package system 10. In accordance with the illustrated embodiment, the case 20 includes a first connector or 50*a* and a second connector 50*b* that permit the lid 24 to pivot about the pivot axis 2. Only one connector will be described for ease of illustrating operation of the connectors 50*a* and 50*b*. Accordingly, reference number 50 can refer to both connectors 50*a* and 50*b*. The connector 50 is configured as a hinge and includes a pair of clamps 52*a* and 52*b* disposed on the base 36 of the case body, and a rod 58 supported by the lid 24. The rod 58 is rotatably positioned within the clamps 52*a* and 52*b*. The base 36 further includes a pair of retainers 54*a* and 54*b* positioned on opposite sides of the clamps 52*a* and 52*b*. The retainers 54*a* and 54*b* help hold the rod 58 in the clamps 52*a* and 52*b*. Each clamp 52*a* has an inner curved leg 56 and an outer curved leg 57 opposed to the inner curved leg 56 to define space (not numbered) therebetween. The outer curved leg 57 is aligned with the rear edge 37 of the base 36 along the plane P. The base 36 defines slots 55 (see FIG. 11) disposed between the clamps 52*a* and 52*b*, and also between each clamp and the retainers 54*a* and 54*b*. The rod 58 extends from the wall 42 along a direction that is parallel to the top cover 40 and is supported by extensions 59. The retainers 54*a* and 54*b* hold the rod 58 in position in the clamps 52*a*, 52*b* and limit vertical displacement of rod 58 and release from the clamps 52*a*, 52*b*. As illustrated, the rod 58 is positioned in the space between the inner and outer curved legs 56 and 57 such that the rod 58 is rotatable relative to the outer and inner curved legs 56 and 57 about the pivot axis 2. As the lid 24 moves between the closed and the open positions, the extensions 59 of the rods 58 travel through the slots 55 in the base 36. Because the rod 58 is positioned in the clamps 52*a*, 52*b*, the pivot axis 2 is disposed inboard from the base edge 37, which is also inboard of the plane P aligned with rear segments 39*d* and 39*e*. As a result, the connectors 50 are disposed within the interior space 28 of the case 20. When the lid 24 pivots about the pivot axis 2 from the open position into the closed position, the rear wall 42 is substantially aligned with the rear wall segments 39*d* and 39*e*. When the case 20 is closed the rear 24*c* of the case 20 is generally smooth.

Figure 9:
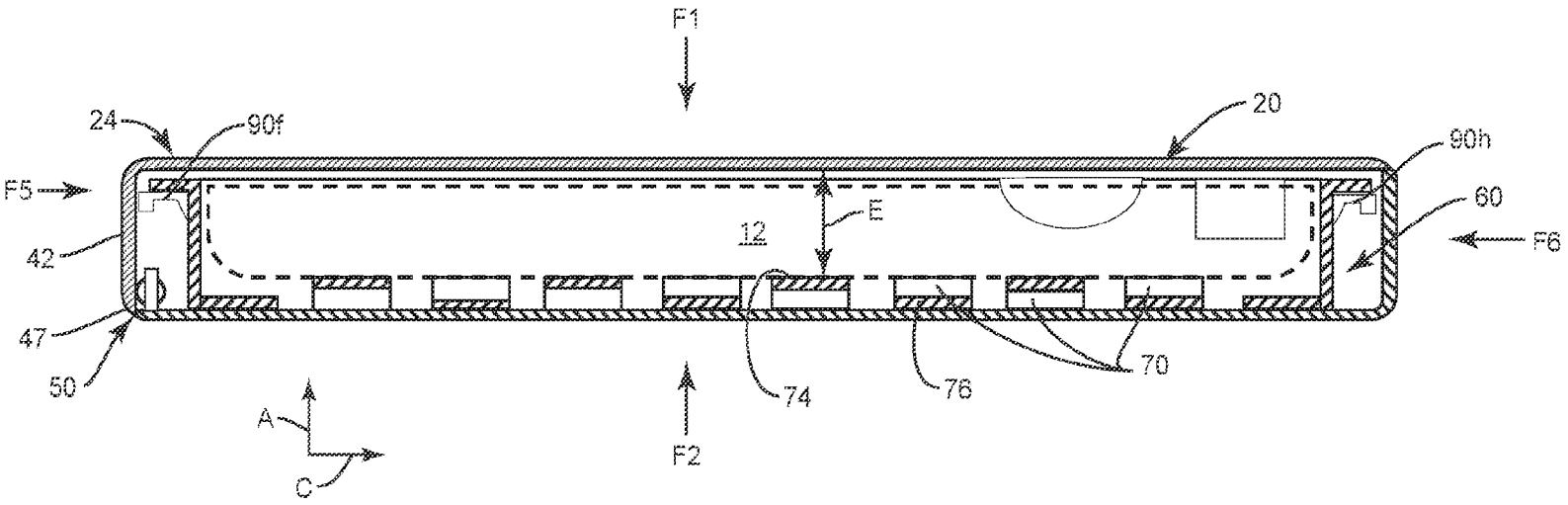
FIG. 9 is a cross-sectional view of the package system shown in FIG. 1 taken along lines 9-9 in FIG. 8.
Figure 10:
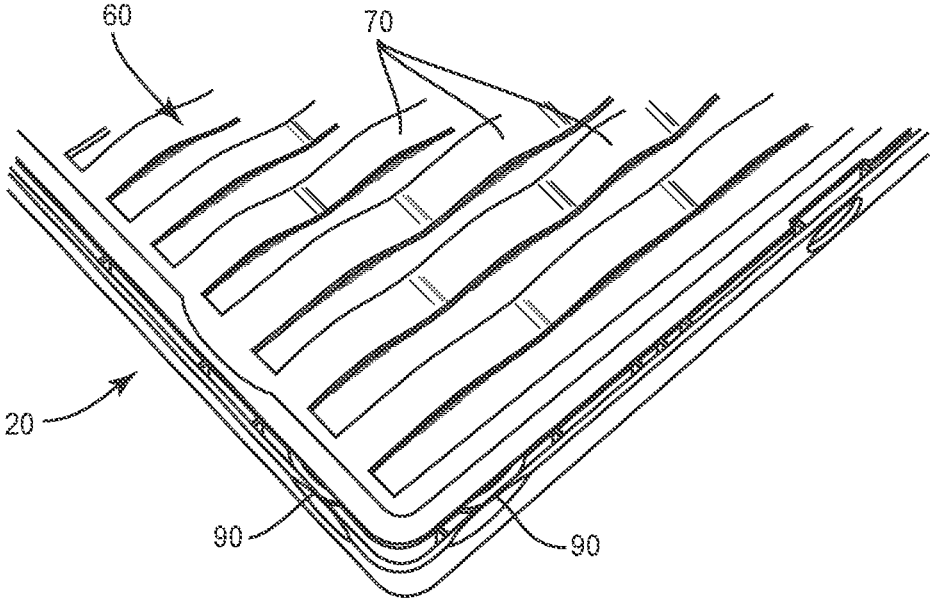
FIG. 10 is a detailed partial perspective view of an open package system shown in FIG. 8, with case the open and the electronic device removed.

Turning to FIGS. 9 and 10, the case 20 is sized to receive and contain the suspension unit 60. As noted above the suspension unit 60 includes a plurality of suspension elements that support the electronic device 12 against displacement in the case 20 while also absorbing impact forces applied to the case 20 during transit. The suspension unit 60 is configured to moveably support the electronic device 12 along at least two, for instance three orthogonal directions A, B, and C. For instance, the suspension unit 60 is configure to provide support the electronic device 12 along the longitudinal direction B, a vertical direction A, and lateral direction C. Although not shown, the case 20 can define longitudinal, vertical, and lateral axes that are perpendicular with respect to each other and intersect at point (not numbered) in the interior space 28 of the case 20. The longitudinal axis is parallel to the longitudinal direction B, the vertical axis is parallel to the vertical direction A, and a lateral axis that is parallel the lateral direction C.

Turning to FIGS. 12A-12D, the suspension unit 60 includes a base 62 and a wall 64 that extends from the base 62 in a direction angularly offset with respect to the base 62. The base 62 and the wall 64 define a receptacle 65 that is sized to receive the electronic device 12 (FIG. 10). As noted above, the suspension unit 60 includes a plurality of suspension elements disposed along the base 62 and wall 64. In accordance with the illustrated embodiment, a first set of suspension elements 70, or base suspension elements 70, are disposed along and defined by the base 62. A second set of suspension elements 90, or side suspension elements 90, are disposed along the wall 64. The base suspension elements 70 are configured to absorb impact forces applied to the case 20 along at least a vertical direction A that extends through the base 62. The side suspension elements 90 are configured to absorb impact forces applied to the case 20 along the longitudinal direction B and/or the lateral direction C (FIG. 9).

Figure 12A:
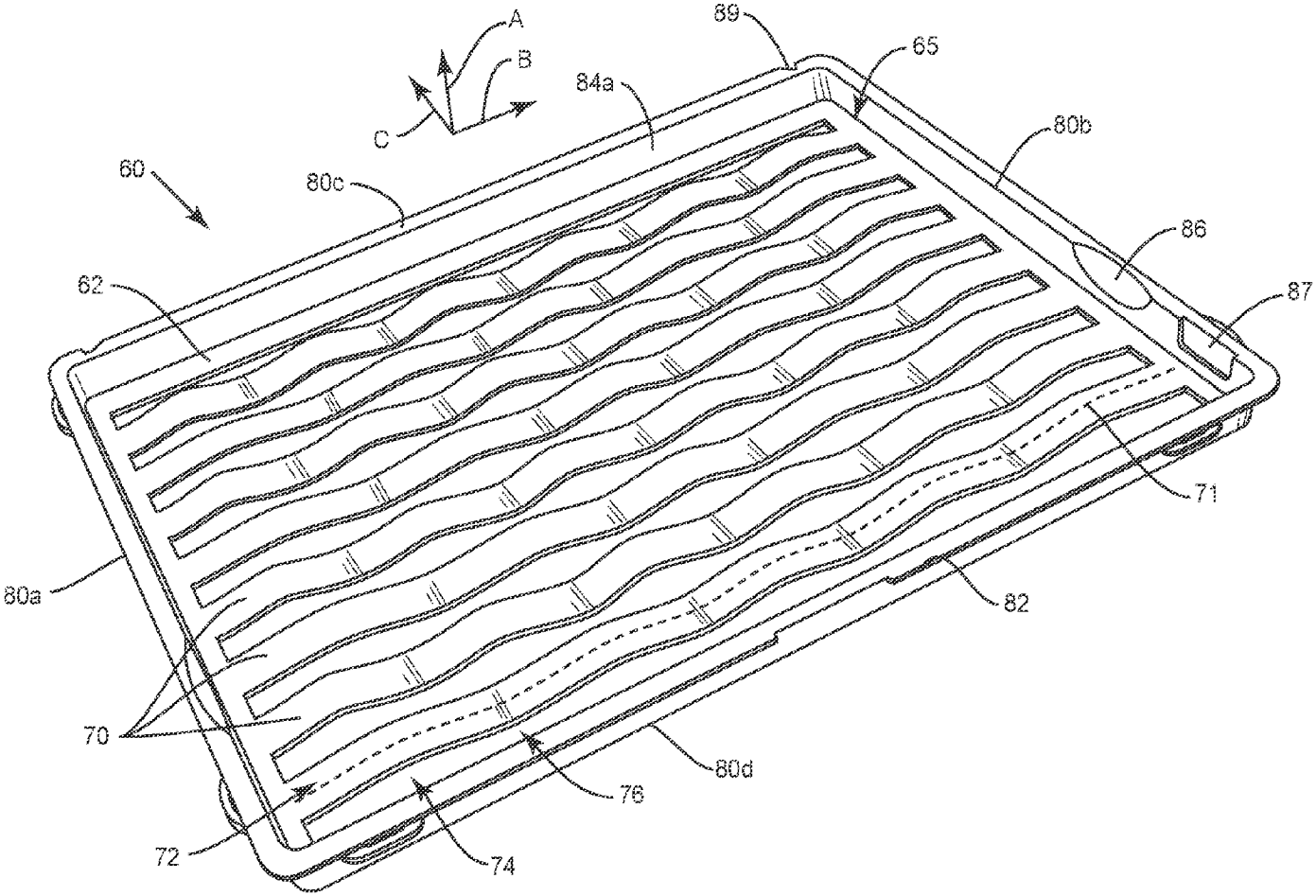
FIGS. 12A, 12B, and 12C are perspective, top, and bottom views, respectively, of the suspension unit shown in FIG. 2.
Figure 12B:
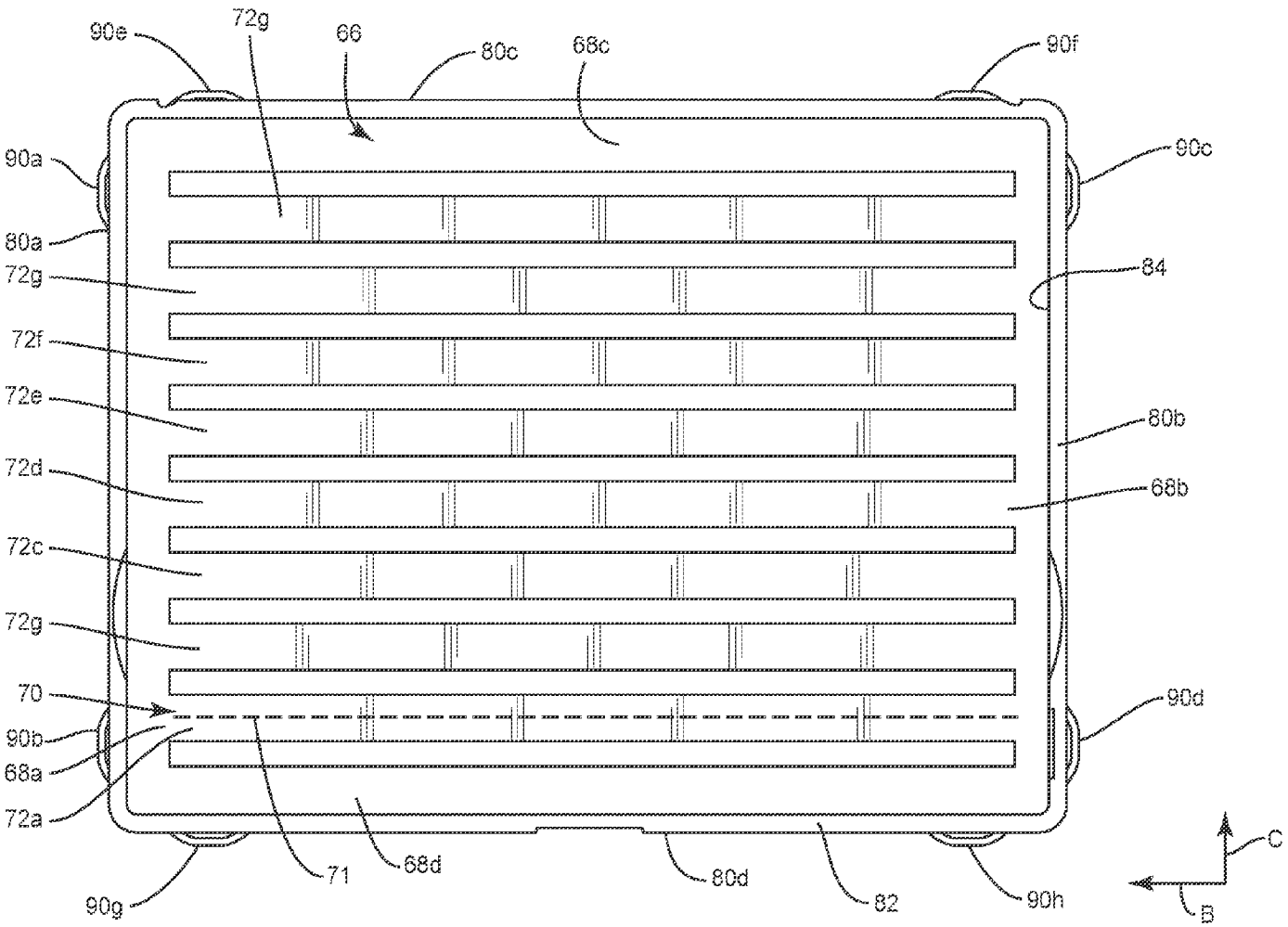
Figure 12C:
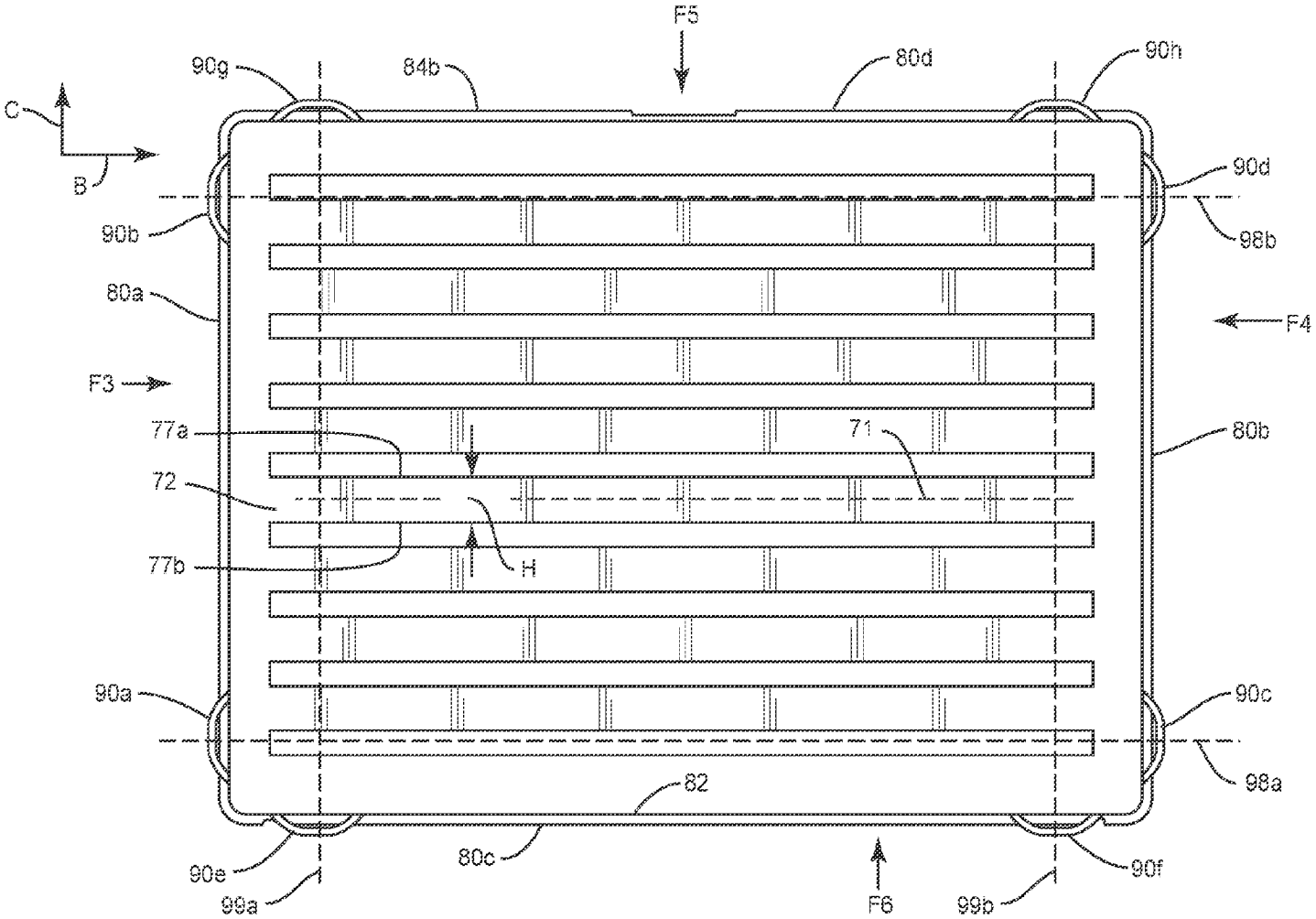
Figure 12D:
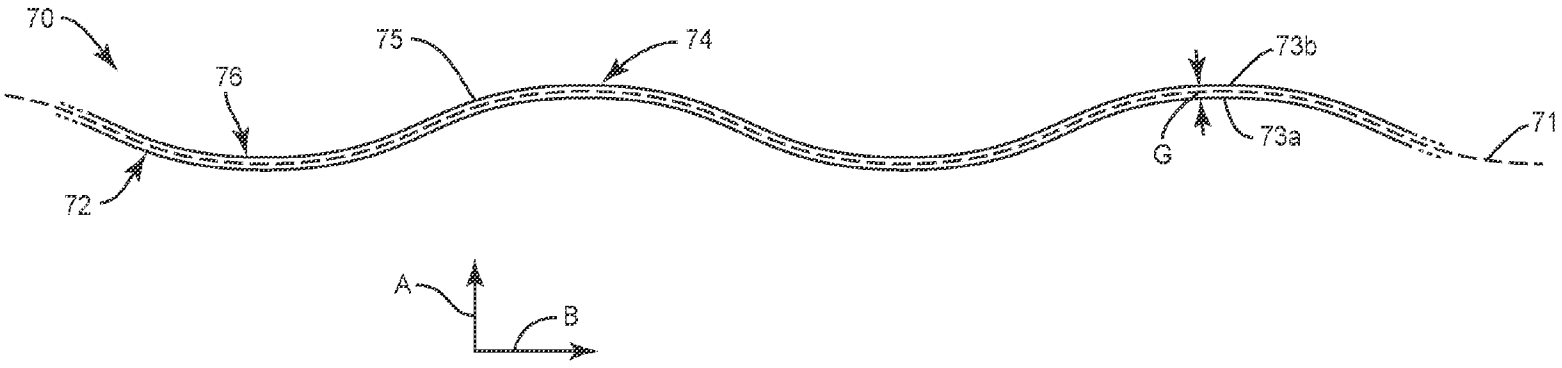
FIG. 12D is a sectional view of a base suspension element of the suspension unit shown FIGS. 12A-12C.

Turning to FIGS. 12B and 12C, the base 62 defines a plurality of base suspension elements 70 configured to support the electronic device 12. In accordance with the illustrated embodiment, the base includes an outer rim 66 having a first end 68*a*, a second end 68*b* spaced from the first end 68*b* in the longitudinal direction B, a rear end 68*c*, and a front end 68*d* opposed to the rear end 68*c* in the lateral direction C. The base suspension elements 70 include an array of suspension bodies 72*a*, 72*b*, 72*c*, . . . 72*h* that extend from rim end 68*a* to rim end 68*b* and are further spaced apart along the lateral direction to define a gap that extends between adjacent suspension bodies 72. Each suspension body 72 (72 is used interchangeably with 72*a*, 72*b*, . . . 72*h*) is elongate along a suspension body axis 71 that is generally parallel to the longitudinal direction B. Each suspension body 72 includes an undulating profile that defines a plurality of alternating peaks 74 and valleys 76 spaced apart along the axis 71 with transverse segments 75 that extend between adjacent peaks and valleys 4 and 76. When the suspension unit 60 is inside the case 20, the peaks 74 are spaced apart from the inner surface 35 of the case 20 in the vertical direction V. In addition, as best shown in FIG. 9, the peaks 64 are spaced from the inner surface 49 of the top cover 40 a distance E. The distance E can be slightly less than a thickness of the electronic device 12. In alternative embodiments, the peaks 74 and valleys 77 can be defined by substantially linear transverse segments 75 intersecting to define respective peaks 74 and valleys 76. Further, the suspension bodies 72 can be figured so that an upper flat portion parallel to the base that defines the peak 74 and a lower flat portion parallel to the base that defines the valley 76.

Continuing with FIGS. 12A-12D, the dimensions of each suspension body 72 are configured to support the electronic device 12. In accordance with the illustrated embodiment, each suspension body 72 also defines an lower surface 73*a*, a upper surface 73*b*, and a suspension body thickness G that extends from the lower surface 73*a* to the upper surface 73*b*. The thickness G is consistent along an entire length of the suspension body 72. It should be appreciated, that the suspension body thickness G can vary along different portions of the suspension body 72. For instance, the peaks 74 can have a first thickness, the valleys 76 can have a second thickness, and the transverse segments can have a third thickness such that the first, second, and third thicknesses are different from the each other (first, second and third thickness not numbered in the drawings). In addition, each suspension body 72 can define a suspension body width H that extends from a first edge 77*a* to a second edge 77*b* along a direction perpendicular to the axis 71. The suspension bodies 72 illustrated have a constant width H that extends along the axis 71. In alternative embodiments the width H can vary along the axis 71 as needed. The suspension body width H is greater than the suspension body thickness G defining substantially rectilinear cross-sectional shape that is perpendicular to the axis 71. The cross-sectional shape is not limited to the shape illustrated. Rather, the body 72 can have any desired cross-sectional shape, such as circular, oval, or a shape having a combination of linear and curved components. Any one of the suspension body width H and suspension body thickness G can be modified as needed to adjust the stiffness of the suspension bodies 72 and thereby impact the deflection characteristics of the suspension elements 70 arranged along the base 62.

Figure 14A:
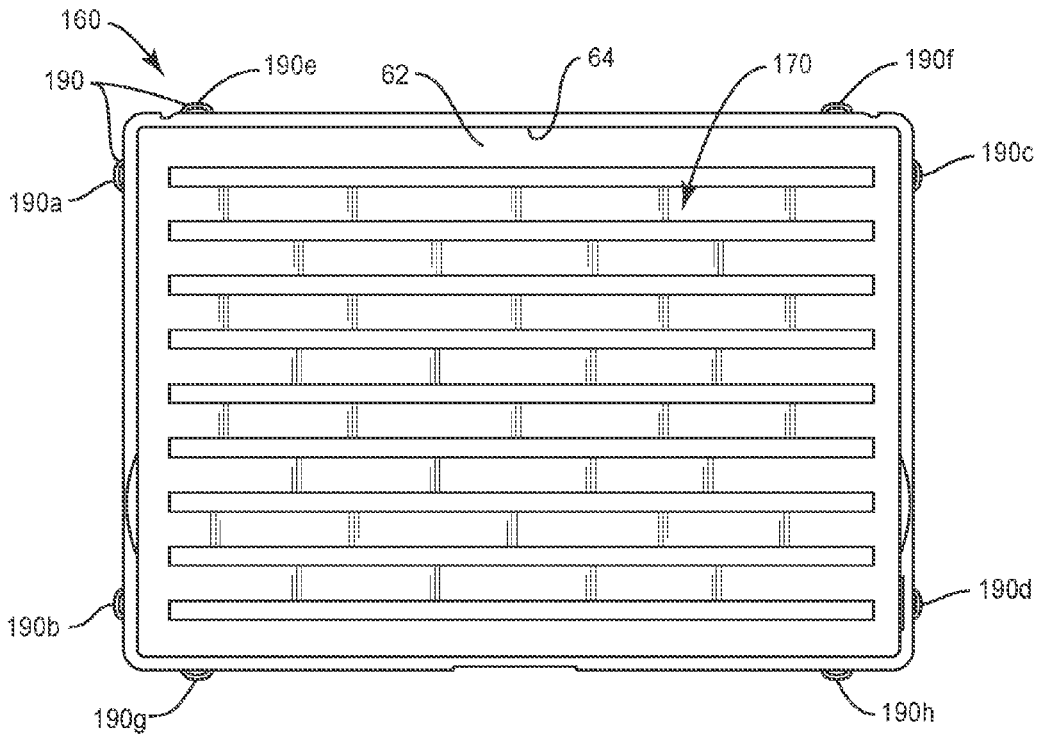
FIGS. 14A, 14B and 14C are top, bottom, and detailed bottom views, respectively, of a suspension unit according to another embodiment of the present disclosure.
Figure 14B:
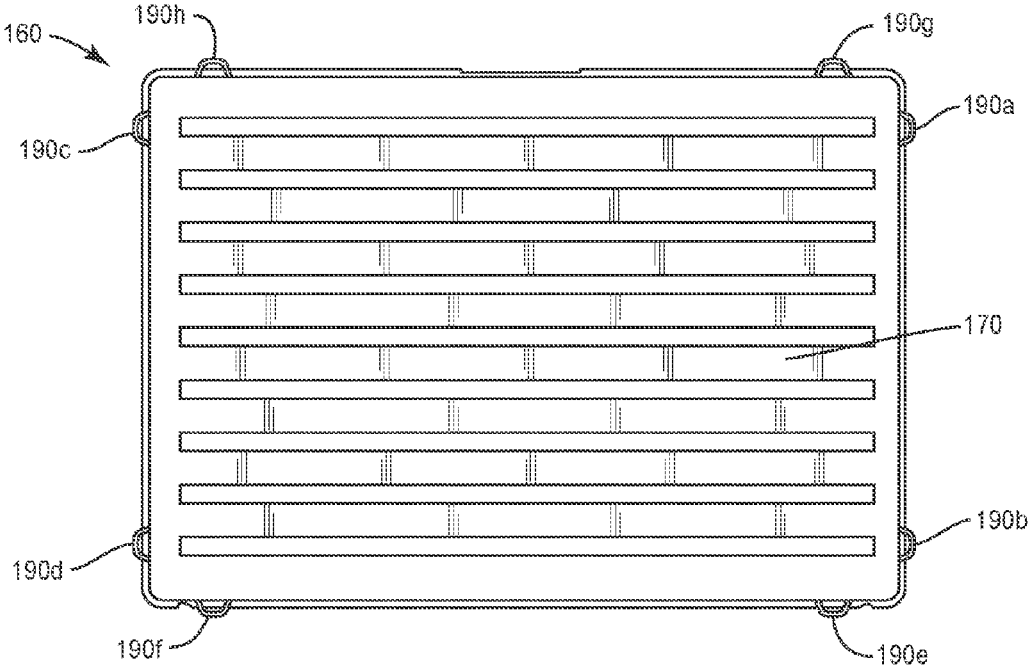
Figure 14C:
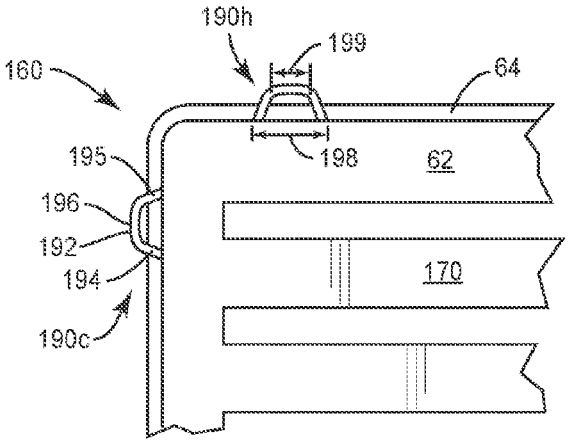
Figure 15A:
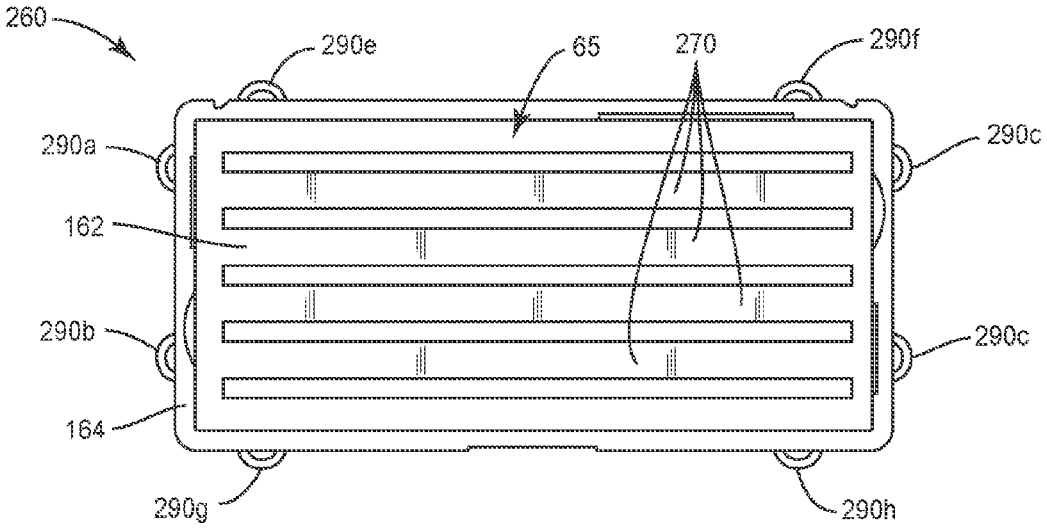
FIGS. 15A and 15B are top and bottom views, respectively, of a suspension unit according to another embodiment of the present disclosure.
Figure 15B:
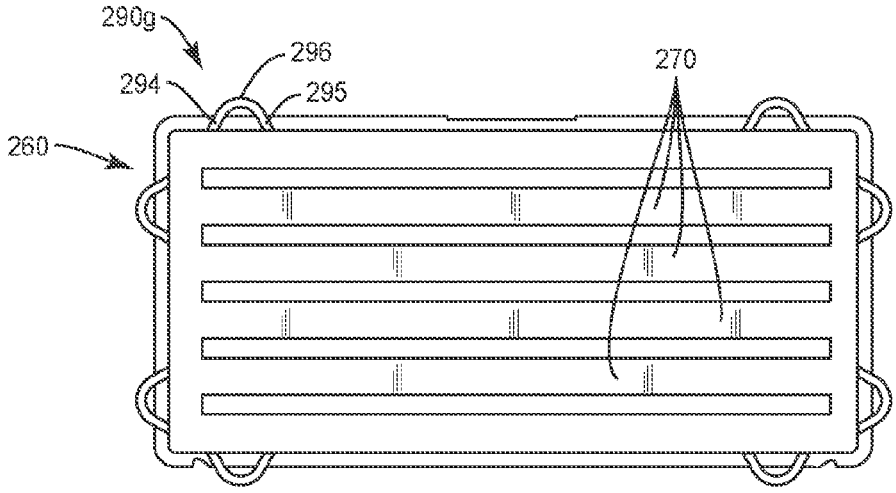

Further, the number of suspension elements 70 can be selected based on the weight and dimensions of the electronic device 12. In accordance with the embodiment illustrated in FIGS. 12A-12C, the suspension unit is configured to hold and support an iPadAir having a weight between 1.0 n (456 g) and 1.05 lbs (478 g), a length of 9.4 inches (240 mm), a width of 6.6 in (169.5 mm), and depth of 0.29 in (7.5 mm). In the embodiment illustrated, the suspension unit 60 has eight suspension elements 70. More or less suspension elements 70 could be used. For instance, FIGS. 14A-14C illustrate an alternate embodiment of the suspension unit 160 configured for the iPad mini and including eight suspension elements 70 but having suspension bodies 172 with a smaller width G compared the suspension bodies 72 illustrated in FIGS. 12A-12C. FIGS. 15A-15B illustrate an alternate embodiment of the suspension unit 260 configured for the an iPhone, such as the iphone 5S having a weight between 3.95 oz (112 g), a length of 4.87 inches (123.8 mm), a width of 2.31 in (58.6 mm), and depth of 0.3 in (7.6 mm). The suspension unit 260 includes just four suspension elements 270 with suspension bodies 272 having a width that is similar the width G of the suspension bodies 72 shown in FIGS. 12A-12C used to support the iPad Air. Further details concerning the suspension units 160 and 260 will be described below.

Figure 8:
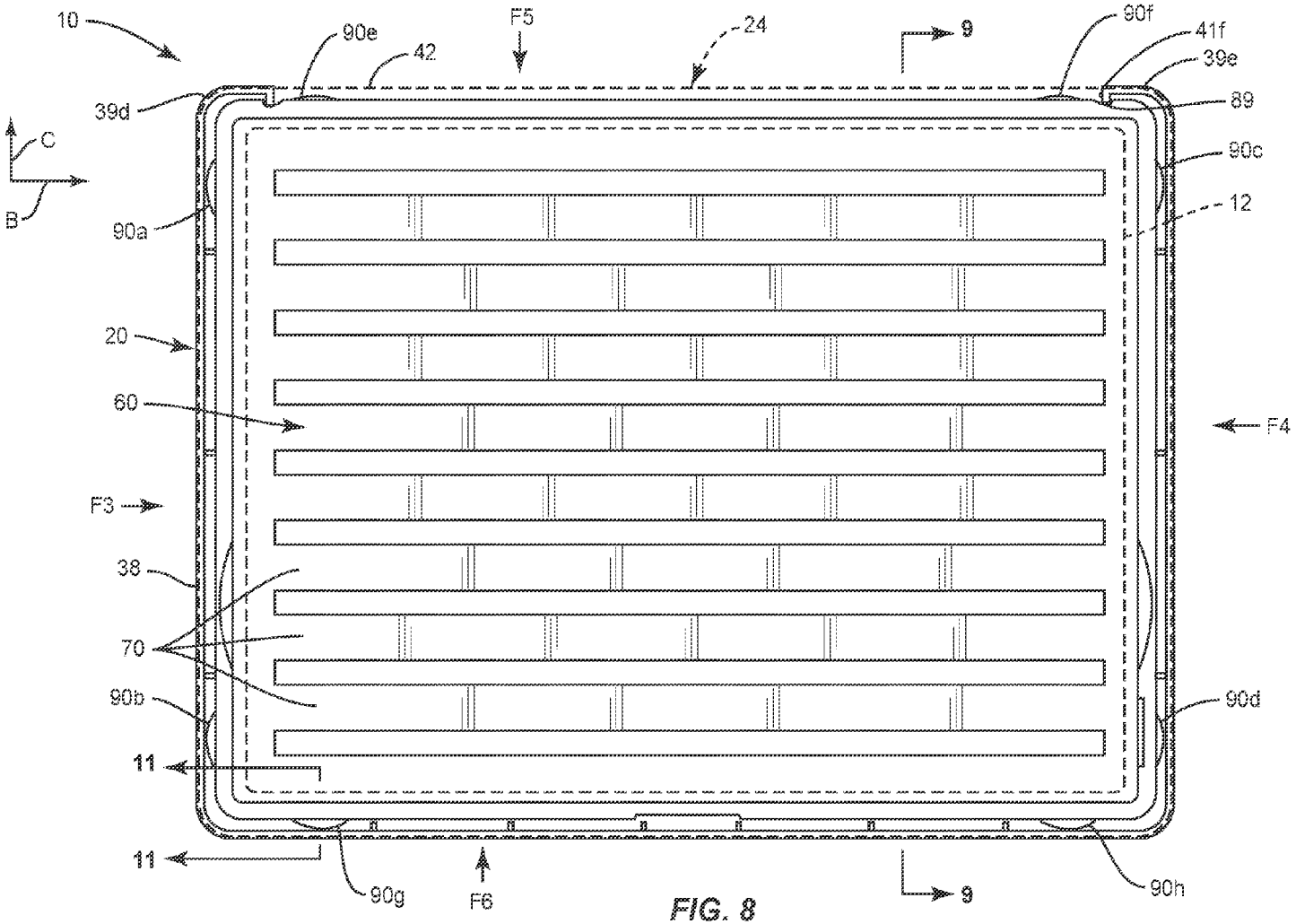
FIG. 8 is a top view of the package system shown in FIG. 1, illustrating the electronic device supported by the suspension unit positioned in the case, with the top of the case and the electronic device shown in dashed lines for clarity.

Referring to FIGS. 12A-13B, the wall 64 extends from the base 62 around an entire periphery of the base 62. The wall 64 includes a plurality of wall segments including a first wall segment 80*a*, a second wall second 80*b* spaced from the first wall segment 80*a* in the longitudinal direction B, a rear wall segment 80*c*, and a front wall segment 80*b* opposed to the rear wall segment 80*d* in the lateral direction C. A lip 82 extends from a top of the wall 64 outwardly in direction away from the receptacle 65. The wall 64 further defines an inner surface 84*a* and an outer surface 84*b* such that inner surface 84*a* define the receptacle 65 and the outer surface 84*b* faces the side wall 38 of the case body 12 (FIG. 5). The lip 82 disposed along the rear wall segment 80*d* includes notches 89 (FIG. 12A) that receive wall tabs 41*d* and 41*e* (FIG. 8). The inner surface 84*b* of the wall 64 defines curved indentations 86 that are sized as finger inserts to aid in removing the electronic device 12 from suspension unit 60. Relief features 87 accommodate buttons or other surface features of the electronic device 12.

Figure 11:
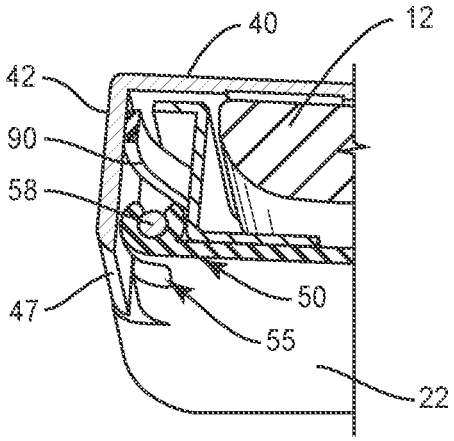
FIG. 11 is a partial sectional perspective view of the package system shown in FIG. 1, taken along line 11-11 in FIG. 8.
Figure 13A:
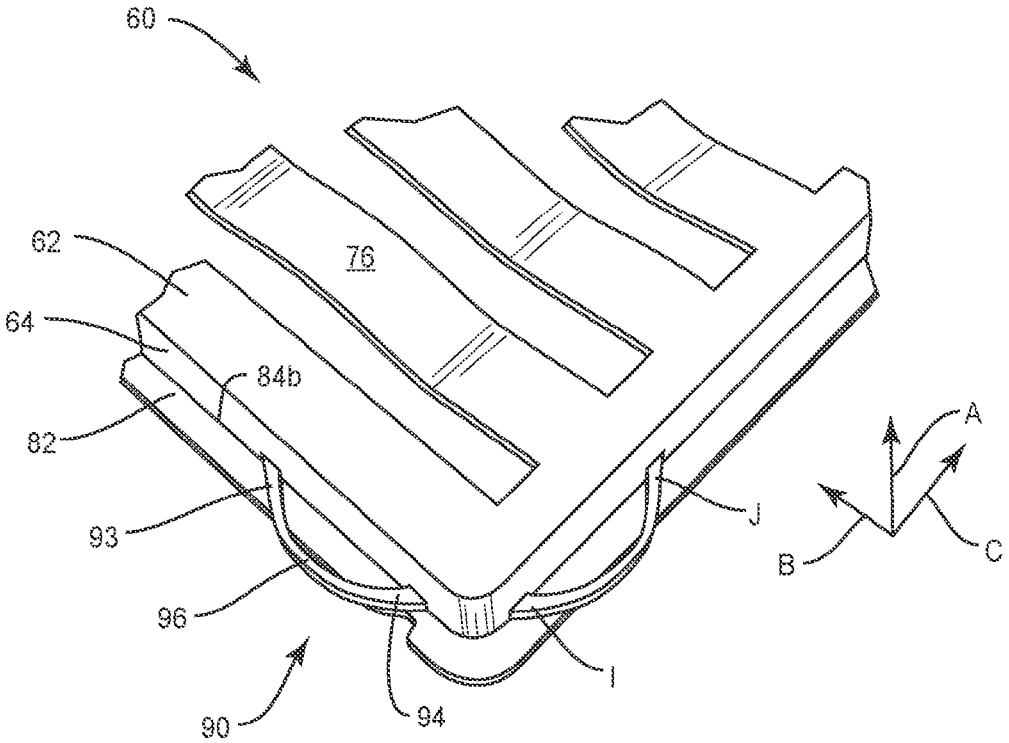
FIG. 13A a bottom detailed view of a portion of the suspension unit shown FIGS. 12A-12C.
Figure 13B:
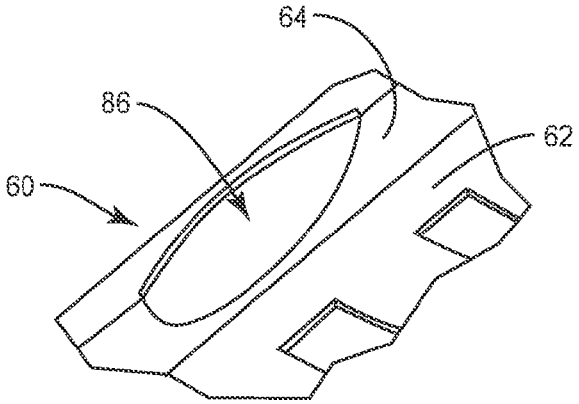
FIG. 13B is a top detailed view of a portion of the suspension unit illustrated in FIGS. 12A-12C.

As best shown in FIGS. 12C and 13A, each wall segment 80*a*-80*b* includes one or more side suspension elements 90 that are configured to support the electronic device 12 against displacements or impact forces to the case 20 along the longitudinal or lateral directions B and C. In accordance with the illustrated embodiment, each side suspension element 90 is a biasing member, such as a leaf spring. The wall 64 includes side suspension elements 90*a*, 90*b*, 90*c*, . . . 90*h* disposed in pairs along each wall segment 80*a*-80*d*. Reference number 90 will refer also to any one of the suspension elements 90*a*, 90*b*, 90*c*, . . . 90*h*. Each side suspension element 90 includes a side suspension body 92 that defines a first leg 93, a second leg 94, a contact member 96 spaced apart from the outer surface 84*b* of the wall 64 beyond a terminal edge (not numbered) of the lip 82. The contact member 96 can be a leg or body that is configured to abut the side wall 38 of the case body 22 (FIGS. 9, 11). The side suspension body 92 defines a thickness I that extends along vertical direction A and width J that is perpendicular the thickness. In accordance with the illustrated embodiment, the thickness I of contact member 96 can be different than the thickness of the first and second legs 93 and 94. Further, the width J can vary along the first and second legs 93 and 94 and the contact member 96. For instance, as illustrated the contact member 96 has a greater thickness than the thickness of the first and second legs 93 and 94 and width J is generally consistent across legs 93, 94 and 96. The first and second legs 93 and 94 extend along a direction that is angularly offset with respect to the outer surface 84*b* of the wall 64, while the contact member 96 is substantially parallel to the wall 64. In response to a force applied along a direction normal to the wall 64 of the suspension unit 60, the legs 93 and 95 bend and the contact member 96 can be displaced toward the wall 64.

Referring now to FIG. 12C, in accordance with the illustrated embodiment side suspension elements 90 are disposed along each wall segment 80*a*-80*b*. For instance a first pair of side suspension elements 90*a* and 90*b* are disposed along the first wall segment 80*a*. A second pair of side suspension elements 90*c* and 90*d* are disposed along the second wall segment 80*b*. A pair of rear side suspension elements 90*e* and 90*f* are disposed along the rear wall segment 80*c*, and a pair of front side suspension elements 90*g* and 90*h* are disposed along the front wall segment 80*d*. The side suspension elements 90 are disposed toward the corners 69*a* of the suspension unit 60 and are aligned in order to distribute forces applied in the longitudinal direction B and/or lateral direction C across the length or width of the suspension unit 60. For instance, the first pair of end side suspension elements 90*a* and 90*b* can be aligned with the second pair of end side suspension elements 90*c* and 90*d* along a respective pair of axes 98*a*, 98*b* that are parallel to the longitudinal direction B. The rear biasing member 90*e* and 90*f* can be aligned with the front side suspension element pairs 90*g* and 90*h* along a respective axes pair of axes 99*a*, 99*b* that are parallel to the lateral direction C.

Returning to FIGS. 9 and 10, in use when the electronic device 12 is placed in the suspension unit 60 and the lid 24 is closed, the top cover 40 urges the electronic device 12 downwardly and applies a downwardly directed force F1 against the peaks 76 that is transferred to the transverse segments 75 toward the valleys 76. Because the valleys 76 abut the base of the case body 22, the suspension elements 70 apply an upwardly directed force F2 against the electronic device 12 that opposes the downwardly direction force F1. While the case 20 clamps the electronic device 12 between the suspension unit 60 and the top cover 42, the suspension elements 70 can still deflect in response to sudden external forces or shocks directed along the vertical axis 4. With the electronic device 12 clamped in position with respect to vertical displacement, impact forces applied the case 2 to bottom 30 or top 32 are absorbed through continued deflection of the suspension element 70 in response to such impact forces. It can be said that base suspension elements 70 are configured to deflect in response to a first force F1 applied against the suspension elements 70 along a first direction or vertical direction V. Further, each side suspension element 90 is in contact with or adjacent to the side wall 38 and rear wall 42. A force F3 applied to suspension elements 90*a* and 90*b* along the longitudinal direction B toward wall segment 80*a* biases the respective contact members 96 toward the wall 64 of the suspension unit 60 absorbing some component of the force F3. Likewise, a force F4 applied to side suspension elements 90*c* and 90*d* along the longitudinal direction B toward wall segment 80*b* biases the respective contact members 96 toward the wall 64 of the suspension unit 60 absorbing some component of the force F4. A force F5 applied to rear side suspension elements 90*e* and 90*f* along the lateral direction C direction L toward wall segment 80*c* biases the respective contact member 96 of suspension elements 90*e* and 90*f* toward the wall 64 of the suspension unit 60 absorbing some component of the force F5. Further, a force F5 applied to side suspension elements 90*g* and 90*g* along the lateral direction L toward wall segment 80*d* biases the respective contact members 96 of side suspension elements 90*g* and 90*h* toward the wall 64 of the suspension unit 60 absorbing some component of the force F4. Thus, the side suspension elements 90 can absorb some up to all of the forces applied to case along the longitudinal direction B and the lateral direction C, while the base suspension elements can absorb some up to all of the impact forces applied the case 20 along the vertical direction. It should be appreciated that each suspension element can flex independently to absorb impact forces applied to the case 20. Further while forces described as being applied along specific directions, the suspension elements are configured to absorb impact force along any directional component.

FIGS. 14A through 15B illustrated alternate embodiments of package systems 110 and 210 that include suspension units 160 and 260 configured for different sized electronic devices. FIGS. 16A-17B illustrated alternative embodiments for the side suspension elements suitable for use in any one of the suspension units 60, 160 and 260 described herein. The suspension unit 160 and 260 illustrated in FIGS. 14A-15B can be used with case that is similar to the case 20 described above and illustrated in FIGS. 1-3 and 9. The dimensions of the case used with suspension unit 160 and 260 may differ, but each case includes body 22, a lid 24 and connectors that rotatably connect the lid 24 to the case body 22. The suspension units 160 and 260 are configured similar to the suspension unit 60 except as noted above. Accordingly like reference signs will be used to refer to features common between package systems 10, 110, 210 as well as suspension units 60, 160, and 260.

Turning now to FIGS. 14A-14C, in accordance with an alternative embodiment of the present disclosure, a package system 110 includes a case and the suspension unit 160. The case used with suspension unit 160 is similar to the case 20 described above except for the length, width and thickness of the case. The illustrated embodiment is configured for a smaller tablet, such as the iPad mini. Accordingly, the suspension unit 160 is sized configured for a generally smaller electronic device 12, e.g. the iPad mini, compared to the electronic device that is received in the suspension unit 60 described above and shown in FIGS. 12A-13B. The suspension unit 160 includes one more base suspension elements 70 and one or more side suspension elements 190 disposed along the wall 64. In accordance with the illustrated embodiment, the wall 64 includes a side suspension elements 190*a*, 190*b*, 190*c*, . . . 190*h* (each side suspension element is not shown) disposed in pairs along each wall segment 80*a*-80*d*. Each side suspension element 190 includes a side suspension body 192 that defines a first leg 194, a second leg 195, a contact member 196 spaced apart from the wall 64. The first and second legs 194 and 195 extend along a direction that is angularly offset with respect to the wall 64 so as to space the contact member 96 away from the wall 64. The side suspension element 190 has an overall length that extends from the where the first leg 194 extends from the wall 64 to the location where the second leg 195 extends to the wall 64. The overall length 198 is slightly greater than a length 199 of the contact member 196 such that a greater force is generally required to deflect the contact member 196 toward the wall 64 compared to what is required to deflect the contact member 196 in the suspension unit 60 described above that configured for the larger electronic device 12. The side suspension body 192 can have a consistent thickness H and width J.

Figure 7:
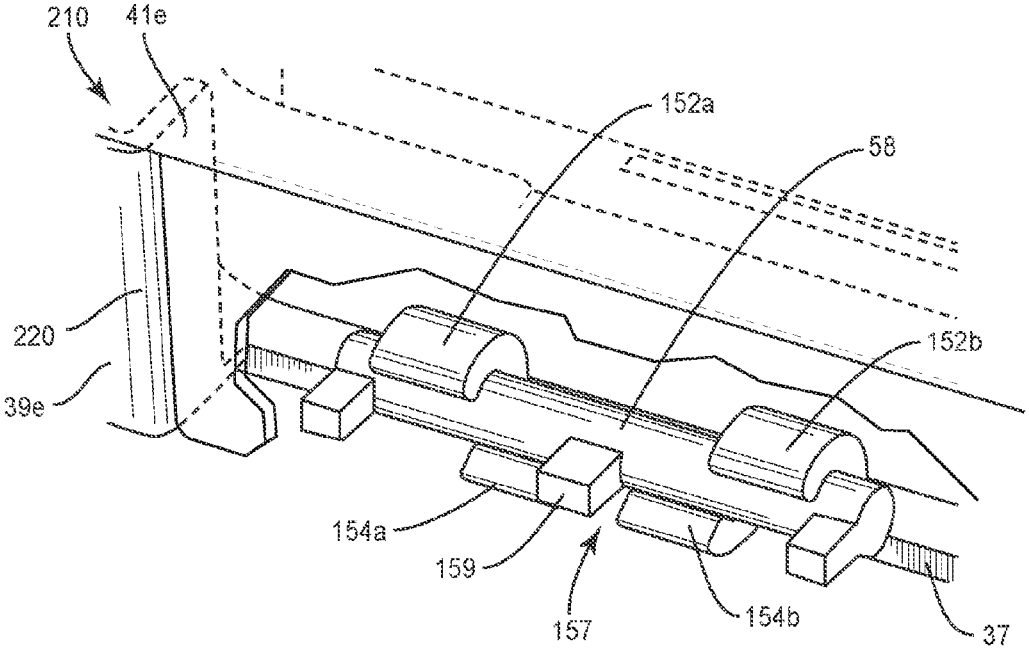
FIG. 7 is a detailed perspective view of a connector for a case according to another embodiment of the present disclosure.

Turning now to FIGS. 7, 15A-15C, in accordance with an alternative embodiment of the present disclosure, a package system 210 includes a case 220 (FIG. 7) and a suspension unit 260. The case used with suspension unit 260 is similar to the case 20 described above except for the length, width and thickness of the case, and the connector that moveably connects the case body 22 to the lid 24. The illustrated embodiment is configured for smartphone. Accordingly, the suspension unit 260 is sized and configured to support such a smartphone, e.g. the iPhone 5S, within the case. Referring to FIG. 7, the case 220 and connector 150 shown in FIG. 7 is similar the case 20 and connector 50 shown in FIG. 6. Accordingly, similar reference signs will be used to refer to elements common to the case 20 and 220 and connector 50 and 150. As illustrated in FIG. 7, the connector 150 includes a plurality of upper curved legs 152*a*, 152*b*, a plurality of lower curved legs 154*a*, 154*b*, and a rod 58 rotatably held in place between the upper and lower curved legs 152*a*, 152*b* and 154*a*, 154*b*. In accordance with the illustrated embodiment, the upper and lower curved legs are offset with respect to each other along the longitudinal direction B and extend outward away from the rear edge 37 of the base 36. The lower curved legs 152 are spaced apart to define a slot 157 therebetween. As the lid 24 rotates from the closed position into the open position, the center extension moves between the slot 157 and the outer extensions 159 move in a region spaced from the edge 37 of the base 36. The connector 150, while disposed in the interior spaced 38 of the case 220, is configured to provide clearance for the lid 24 to pivot into the open position without interfering with base 36. The result is a more compact case 220.

Turning now to FIGS. 15A and 15B, the suspension unit 260 includes a base 262, and wall 264, one more base suspension elements 270 defined by the base 262, and one or more side suspension elements 290 disposed along the wall 264. In accordance with the illustrated embodiment, the base 262 defines four suspension elements 270 though more or less suspension elements 270 could be used as needed. The wall 264 includes a side suspension elements 290*a*, 290*b*, 290*c*, . . . 290*h* disposed in pairs along each wall segment 180*a*-180*d*. Each side suspension element 290 includes a side suspension body 292 that defines a first leg 294, a second leg 295, a curved contact member 296 spaced apart from the wall 264 and extending between the first and second legs 294 and 295. The first and second legs 293 and 294 extend along a direction that is angularly offset with respect to the wall 264. Although, each leg can be curved as well.

Figure 16A:
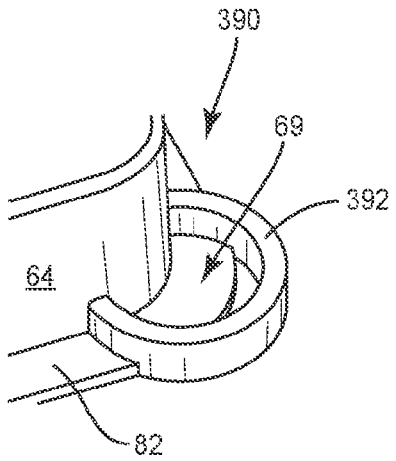
FIG. 16A is a bottom partial perspective view a suspension unit for a package system according to another embodiment of the present disclosure.
Figure 16B:
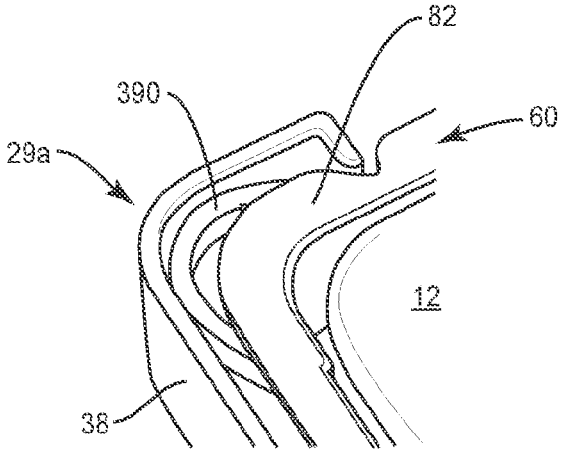
FIG. 16B is a top partial perspective view of the suspension unit shown in FIG. 16A positioned in a case.

Turning now to FIGS. 16A and 16B, a side suspension element 390 of a suspension unit according to an alternative embodiment of the present disclosure is illustrated. In accordance with the alternative embodiment, the side suspension element 390 is a curved body 392 disposed at the corner 69 of the base 62 of the suspension unit. The curved body 392 extends from the wall 64 outwardly from the corner 69 of the lip 82. When the suspension unit 60 is placed in the case body 22 as shown in FIG. 16B, the curved body 392 engages an inner surface of the corner 129 of the case body 22. Positioned in this manner, the suspension element 390 could absorb impacts applied along the longitudinal direction B and the lateral direction C.

Figure 17A:
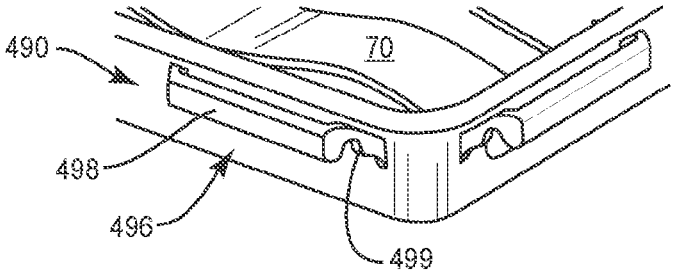
FIGS. 17A and 17B are top and bottom partial perspective views, respectively, of a suspension unit according to another embodiment of the present disclosure.
Figure 17B:
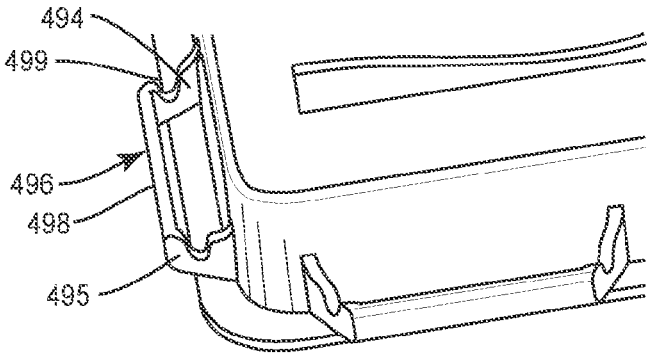

Turning now to FIGS. 17A and 17B, a side suspension element 490 of a suspension unit according to an alternative embodiment of the present disclosure is illustrated. In accordance with the alternative embodiment, the side suspension element 490 includes a side suspension body 492 that defines a first leg 494, a second leg 495, and a contact member 496. The legs 494 and 495 are angled with respect to the wall 64 and toward the lip 82 and includes a notch 499. The contact member 496 includes a planar face 498 that faces the side wall 38 of the case body 22.

Another embodiment of the present disclosure includes a method of manufacturing of any one of the package systems 10, 110, 210 described above. The case 20 and suspension unit 60 is formed from a polymeric compound. The polymeric compound is typically thermoplastic but may be a thermoset. The polymeric compound can include one or more polymers in combination with any number fillers, coloring agents, or other additives as needed. Some exemplary polymeric materials include polypropylene, polyethylene, polylactic acid, and the like. In certain embodiments, the polymeric material can include some percentage of recycled content up to a substantial percentage of recycled contents, such as above 90%. The case 20 and suspension unit 60 can be formed via blow molding, injection molding, thermoforming and the like. The case 20 can be formed in two parts: the case body 22 and the lid 40. The suspension unit 60 can be separately formed. Manufacturing can include assembling the case body 22 and lid 24 into the case 20. The suspension unit 60 can be placed into the interior space 28. At this point the package system 10 can be shipped to any number of distributions centers located throughout the world. An electronic device can then be placed in the receptacle of the suspension unit 60. In embodiments where the package system 10 is used to transport replacement devices, the package system 10 and replacement device can be then shipped to the user. The user can remove the replacement device and place the damaged electronic device into the receptacle 65. The package system with the damaged electronic device can be returned to the manufacturer, a 3$^{rd}$ party handler, or other processor. The damaged device is removed. The empty package system 10 is then ground into particles. The ground particles can used a portion of the polymeric compound used to form the package system components.

What is claimed:

1. A package system configured transport an item, the package system comprising:

a case having a case body and a lid moveably connected to the case body, the lid being moveable between a closed position where the lid encloses an interior space of the case and an open position where the lid does not enclose the interior space; and a suspension unit sized to fit in the interior space of the case, the suspension unit including:

a base;

a side wall that extends from the base in a direction angularly offset with respect to the base, the base and the side wall defining a receptacle that is sized to receive the item;

a plurality of base suspension elements on the base and disposed inward with respect to the side wall, the plurality of base suspension elements being spaced apart with respect to each other along a lateral direction, each base suspension element defining an elongate body that extends in a longitudinal direction that is perpendicular to the lateral direction, the elongate body including a plurality of alternating peaks and valleys disposed relative to each other along the longitudinal direction, wherein the plurality base suspension elements are configured to bend so as to absorb a first force that is applied to the case along a first direction that is perpendicular to the longitudinal direction and the lateral direction; and a plurality of side suspension elements disposed along the side wall, each side suspension element including a contact member spaced apart from the side wall, wherein the side suspension elements are configured to move toward the side wall in response to a second force that is applied to the case in a second direction that is perpendicular to the first direction.

2. The package system of claim 1, wherein the elongated body is elongate along a longitudinal direction.

3. The package system of claim 1, wherein each side suspension element is a biasing member.

4. The package system of claim 3, wherein the biasing member is a leaf spring.

5. The package system of claim 1, wherein each side suspension element includes a first leg and a second leg connected to the contact member, the contact member spaced apart from the side wall so as to abut the base of the case body when the suspension unit is in the interior space of the case, wherein the contact member is configured to move in response to a force applied to the side wall.

6. The package system of claim 1, wherein the side wall includes a rear wall segment and a front wall segment spaced from the rear wall segment along the lateral direction, wherein at least one side suspension element of the plurality of side suspension elements is disposed along each one of the rear wall segment and the front wall segment.

7. The package system of claim 6, wherein the side wall includes a first wall segment and a second wall segment that extends from the front wall segment to the rear wall segment in the longitudinal direction, wherein at least one of the first and second wall segments include at least one side suspension element of the plurality of side suspension elements.

8. The package system of claim 1, wherein the side suspension elements are disposed proximate a corner where adjacent portions of the side wall are joined together.

9. The package system of claim 1, wherein the lid is connected to the base by a connector.

10. The package system of claim 9, wherein the connector is disposed in the interior space of the case body.

11. The package system of claim 10, wherein the connector includes a clamp that is supported by the case body and a rod extending from the lid and rotatably coupled to the clamp.

12. The package system of claim 1, wherein the case and the suspension unit are formed from a polymeric compound.

13. The package system of claim 12, wherein at least a portion of the polymeric compound includes recycled material.

14. The package system of claim 1, wherein the item is an electronic device.

15. The package system of claim 1, wherein the plurality of base suspension elements are between 2 base suspension elements and 10 base suspension elements.

* * * * *